US010118305B2

(12) United States Patent
Wright et al.

(10) Patent No.: US 10,118,305 B2
(45) Date of Patent: Nov. 6, 2018

(54) CUTTING TOOLS

(75) Inventors: David Scott Wright, Snohomish, WA (US); Christine Mary Anderson, Edmonds, WA (US); Curt Backman, Seattle, WA (US); Donald Wayne Coffland, Seattle, WA (US); Aaron Robert Ayers, Granite Falls, WA (US); Donald Richard Young, Tulalip, WA (US)

(73) Assignee: The Boeing Company, Chicago, IL (US)

( * ) Notice: Subject to any disclaimer, the term of this patent is extended or adjusted under 35 U.S.C. 154(b) by 337 days.

(21) Appl. No.: 13/312,252

(22) Filed: Dec. 6, 2011

(65) Prior Publication Data

US 2013/0139392 A1 Jun. 6, 2013

(51) Int. Cl.

| | |
|---|---|
| ***B26B 27/00*** | (2006.01) |
| ***B26B 29/00*** | (2006.01) |
| ***B26B 25/00*** | (2006.01) |
| ***B65B 69/00*** | (2006.01) |

(52) U.S. Cl.

CPC ..... *B26B 27/00* (2013.01); *B26B 25/005* (2013.01); *B65B 69/0025* (2013.01); *Y10T 83/04* (2015.04)

(58) Field of Classification Search

CPC ..... B26B 2029/06; B26B 13/00; B25B 7/22; A45D 29/18

USPC ..... 30/90.3, 272.1, 276, 162, 116, 117, 278; 83/53

See application file for complete search history.

(56) References Cited

U.S. PATENT DOCUMENTS

| | | | | |
|---|---|---|---|---|
| 1,024,924 A | | 4/1912 | Brunhoff | |
| 1,194,528 A | * | 8/1916 | Reid | 56/371 |
| 1,860,454 A | | 5/1932 | Dessell | |
| 1,914,528 A | | 6/1933 | Reid | |
| 2,599,439 A | * | 6/1952 | Drake | 30/151 |
| 2,906,021 A | * | 9/1959 | Cromoga | A22B 5/168 30/155 |

(Continued)

FOREIGN PATENT DOCUMENTS

| | | |
|---|---|---|
| DE | 8218916 U1 | 8/1982 |
| GB | 1402853 A | 8/1974 |

(Continued)

OTHER PUBLICATIONS

Product information for ACT Cable Tie Removal Tool from website cableorganizercom/act/cable-tie-removal-tool/.

(Continued)

*Primary Examiner* — Sean Michalski
*Assistant Examiner* — Fernando Ayala
(74) *Attorney, Agent, or Firm* — Kwan & Olynick LLP

(57) ABSTRACT

A tool for use in cutting a tie wrap that is bound about at least one wire is provided. The tool includes a housing having a first side and a second side, wherein the first side and the second side are coupled together to define a cavity. The housing further includes a groove formed in the first side and in the second side, wherein the groove is in flow communication with the cavity. A blade is coupled to the first side and positioned with the cavity, wherein the blade includes a cutting surface partially extending into the groove. The tool also includes a spacer coupled to the housing and configured to maintain the wire a distance away from the cutting surface when the housing is applied to the tie wrap.

23 Claims, 13 Drawing Sheets

(56) References Cited

U.S. PATENT DOCUMENTS

| | | | | | |
|---|---|---|---|---|---|
| 3,045,348 | A | | 7/1962 | Dungan | |
| 3,085,330 | A | | 4/1963 | Lewinski et al. | |
| 3,153,853 | A | * | 10/1964 | Lipton | 30/294 |
| 3,168,119 | A | * | 2/1965 | Schwester et al. | 140/123.6 |
| 3,624,901 | A | | 12/1971 | Pettit | |
| 3,911,575 | A | | 10/1975 | Anesi | |
| 4,022,182 | A | * | 5/1977 | Lenkevich | B23D 59/002 125/13.01 |
| 4,360,970 | A | | 11/1982 | Ostroski et al. | |
| 4,382,330 | A | | 5/1983 | Harbaugh | |
| 4,442,559 | A | * | 4/1984 | Collins | 7/158 |
| 4,459,717 | A | * | 7/1984 | Halstead | 7/134 |
| 4,707,920 | A | * | 11/1987 | Montgomery | B26B 3/06 30/294 |
| 4,805,818 | A | * | 2/1989 | Harrison | B26B 29/025 224/232 |
| 5,206,965 | A | * | 5/1993 | Rowley | B26B 29/06 30/125 |
| 5,285,576 | A | * | 2/1994 | Taylor | B23D 21/08 30/101 |
| 5,309,802 | A | * | 5/1994 | Mammosser | 83/13 |
| 5,617,635 | A | | 4/1997 | Berns | |
| 5,887,346 | A | | 3/1999 | McCasland | |
| 6,101,721 | A | * | 8/2000 | Medhurst | B26B 1/08 30/125 |
| 6,276,059 | B1 | * | 8/2001 | Kan | 30/2 |
| 6,367,154 | B2 | * | 4/2002 | Degabli | B26B 5/00 30/123 |
| 6,752,053 | B2 | | 6/2004 | Rubicam | |
| 6,938,343 | B2 | * | 9/2005 | Yamagishi | B26B 29/06 30/2 |
| 7,107,688 | B1 | * | 9/2006 | Critelli | B26B 5/001 30/125 |
| 7,213,284 | B2 | | 5/2007 | Huang et al. | |
| 7,290,339 | B1 | | 11/2007 | Schmelzer | |
| 7,624,507 | B2 | | 12/2009 | Bergstrand | |
| 7,958,639 | B2 | * | 6/2011 | Ireland | B26B 3/00 30/2 |
| 8,104,180 | B2 | * | 1/2012 | Swinford | 30/252 |
| 2005/0086812 | A1 | * | 4/2005 | Votolato | B26B 5/001 30/293 |
| 2007/0130782 | A1 | * | 6/2007 | Barton | B23D 45/006 30/371 |
| 2007/0204470 | A1 | | 9/2007 | Lai | |
| 2007/0245571 | A1 | * | 10/2007 | Pearson | B26B 3/08 30/294 |
| 2008/0155838 | A1 | * | 7/2008 | Bergstrand | 30/294 |
| 2009/0071014 | A1 | * | 3/2009 | Chow | 30/275.4 |
| 2009/0188118 | A1 | | 7/2009 | Swinford | |
| 2009/0271988 | A1 | * | 11/2009 | Votolato | B26B 5/003 30/158 |
| 2009/0300920 | A1 | * | 12/2009 | Jiang | B26B 1/042 30/152 |
| 2010/0206148 | A1 | * | 8/2010 | Reyes | 83/53 |
| 2011/0265332 | A1 | * | 11/2011 | Cornell et al. | 30/123 |
| 2012/0110863 | A1 | * | 5/2012 | Brown | A01G 3/086 30/371 |
| 2013/0192069 | A1 | * | 8/2013 | Reibold | B26B 29/02 30/295 |

FOREIGN PATENT DOCUMENTS

| | | | |
|---|---|---|---|
| GB | 2333486 | A | 7/1999 |
| JP | S5419300 | A | 2/1979 |
| JP | 3171128 | | 10/2011 |
| WO | 2005108026 | A1 | 11/2005 |

OTHER PUBLICATIONS

Google image search for wire tie cutter, retrieved Sep. 2, 2011 from http://www.google.com/search?q=wire+tie+cutter&hl=en&prmd=imvns&source=lnms&tbm=isch&ei=_13eTvzDMsXY2AWt4eSBBQ&sa=X&oi=mode_link&ct=mode&cd=2&ved=0CF8Q_AUoAQ&biw=1680&bih=853 (5 pgs).

Google image search for cable tie cutter, retrieved Sep. 2, 2011 from http://www.google.com/search?q=cable+tie+cutter&hl=en&prmd=imvns&source=lnms&tbm=isch&ei=Ul7eTrzZJue62wW1yoHqBA&sa=X&oi=mode_link&ct=mode &cd=2&ved=0CFMQ_AUoAQ&biw=1680&bih=853 (5 pgs).

Google image search for zip tie cutter, retrieved Sep. 2, 2011 from http://www.google.com/search?q=zip+tie+cutter&hl=en&prmd=imvns&source=inms&tbm=isch&ei=hF7eTt3NIYe42wXz49i3BQ&sa=X&oi=mode_link&ct=mode&cd=2&ved=0CFwQ_AUoAQ&biw=1680&bih=853 (6 pgs).

International Search Report and Written Opinion of International Application No. PCT/US2012063306; dated Apr. 12, 2013; 17 pages.

International Search Report and Written Opinion of International Application No. PCT/US2012063329; dated Feb. 7, 2013; 10 pages.

International Preliminary Report on Patentability (IPRP) dated Jun. 10, 2014, for co-pending International Application No. PCT/US2012/063329 (5 pages).

Chinese Office Action for Application No. 2012800584878, dated Aug. 6, 2015, pp. 12.

Canadian Office Action issued in Canadian Patent Application No. 2,851,292 dated Apr. 30, 2015; 4 pp.

Chinese Office Action issued in Chinese Patent Application No. 201280058487.8 dated Jan. 12, 2015.

"Canadian Application Serial No. 2,851,292, Office Action dated Mar. 8, 2016", 3 pgs.

"Chinese Application Serial No. 2012800584878, Office Action dated Feb. 1, 2016", 5 pgs.

"Japanese Application Serial No. 2014-545903, Office Action dated Mar. 24, 2015", 5 pgs.

* cited by examiner

CUTTING TOOLS

BACKGROUND OF THE INVENTION

The present disclosure relates generally to a cutting tool, and more specifically, to methods and systems for cutting fasteners.

Fasteners such as tie wraps, also known as "zip ties," are commonly used for a variety of purposes in industrial settings. For example, such tie wraps are commonly used to secure electrical wires in bundles. It is common, particularly in routing electrical wires, to use tie wraps to bind bundles of wires together. The binding of wire bundles allows similar groupings of wires to be grouped together to facilitate installation of the wires. Further, tie wraps prevent wires from tangling and enables better wire management.

Known tie wraps include a strap having a securing mechanism integral therewith. A distal end of the tie wrap is passed through an opening in the securing mechanism. The securing mechanism contains a tab that engages teeth spaced along the length of the strap. The tab engages successive teeth as the strap is pulled through the securing mechanism. Moreover, the tab acts as a ratchet to effectively prevent the strap from being removed after it is installed.

Tie wraps are sometimes removed after installation of the wire bundles and/or during later maintenance operations. Typically, personnel use conventional wire cutters, razor knives, or similar cutting tools to remove the tie wraps. During removal of the tie wraps, insulation covering one of the wires may be moderately nicked or cut with the cutting tool. Damaged insulation may require repair or require the wire and/or the bundle of wires to be replaced, this damage leads to costly and/or time-consuming outages or delays. Further, in some instances, conventional cutting tools have exposed blades that may result in minor injuries that require attention and further delay.

BRIEF DESCRIPTION OF THE INVENTION

In one aspect, a tool for use in cutting a tie wrap that is bound about at least one wire is provided. The tool includes a housing having a first side and a second side, wherein the first side and the second side are coupled together to define a cavity. The housing further includes a groove formed in the first side and in the second side, wherein the groove is in flow communication with the cavity. A blade is coupled to the first side and positioned within the cavity, wherein the blade includes a cutting surface partially extending into the groove. The tool also includes a spacer coupled to the housing and configured to maintain the at least one wire a distance away from the cutting surface when the housing is applied to the tie wrap.

In another aspect, a tool for use in cutting a tie wrap that is bound about at least one wire is provided. The tool includes a housing having a first side and a second side, wherein the first side and the second side are coupled together to define a cavity. The housing further includes a first groove and a second groove formed in the first side and in the second side, wherein the groove is in flow communication with the cavity. A blade is coupled to the first side and positioned within the cavity, wherein the blade includes a cutting surface extending into the first groove and the second groove. The tool also includes a spacer coupled to the housing. The spacer is configured to maintain the at least one wire a distance away from the cutting surface when the housing is applied to the tie wrap.

In a further aspect, a method of operating a cutting tool for cutting a tie wrap bound about at least one wire is provided. The method includes applying a housing of the tool to the tie wrap. The method further includes positioning a portion of the tie wrap within a groove of the housing. A spacer moves the at least one wire and maintains the at least one wire a distance away from the tie wrap. Method further includes moving a blade of the tool against the portion of the tie wrap positioned within the groove. The method also includes at least partially cutting the tie wrap with the blade.

The features, functions, and advantages that have been discussed can be achieved independently in various embodiments or may be combined in yet other embodiments further details of which can be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION OF THE INVENTION

The embodiments described herein relate to a resilient cutting process. Generally, the embodiments relate to a cutting tool for cutting a fastener that contains an object, such as a bundle of wires. The cutting tool is utilized to cut a plurality of fasteners such as, but not limited to, strings, adhesives, wires and tie wraps. Moreover, the cutting tool is utilized to cut fasteners used in a variety of environments such as, but not limited to, industrial, military and consumer environments. In one application, the cutting tool described herein is utilized to cut a tie wrap disposed about a bundle of wires. It should be understood that the embodiments described herein are not limited to tie wraps, and further understood that the description and figures that utilize tie wraps and wires are exemplary only. The present invention is compatible with known tie wraps while providing a cutting process that is safe, ergonomic and non-damaging to wires contained by the fastener being cut.

Figure 1:
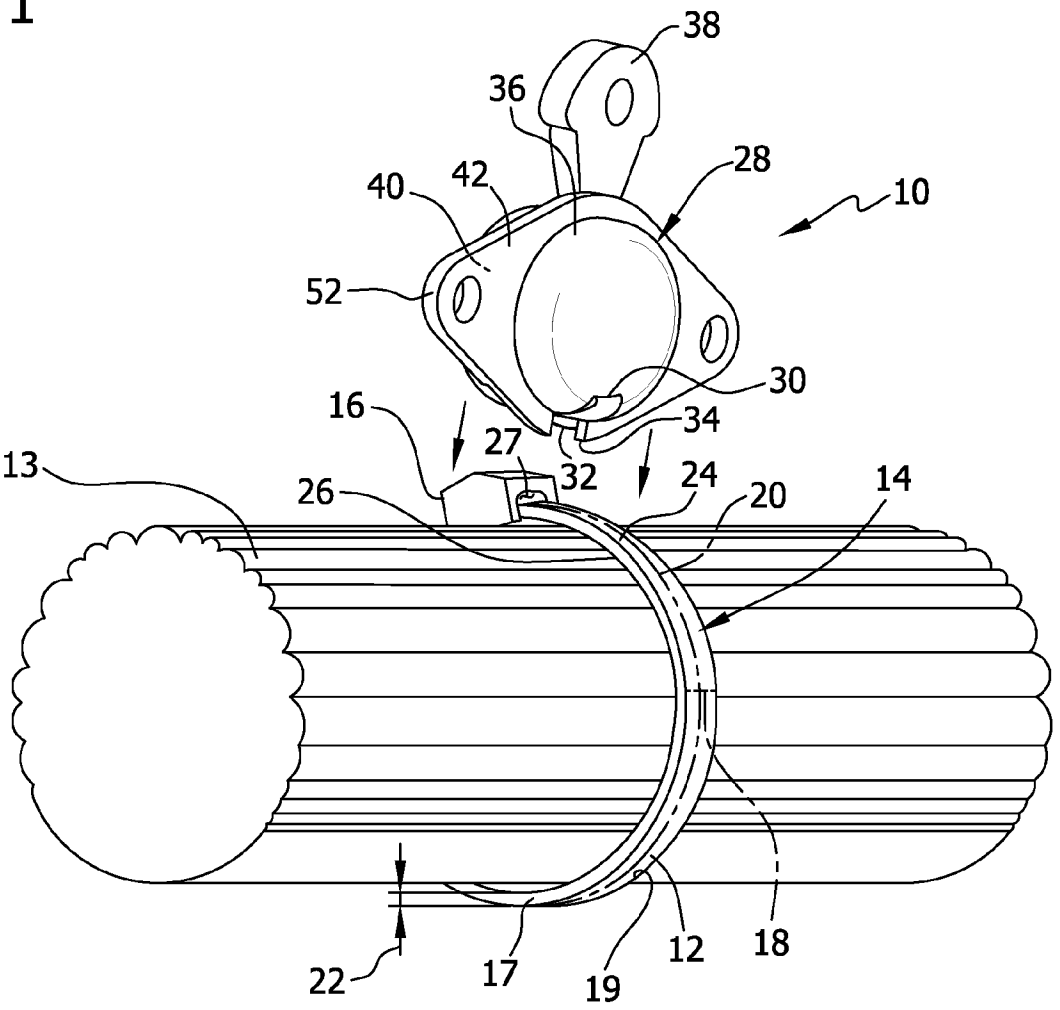
FIG. 1 illustrates a perspective view of an exemplary cutting tool that may be used to cut a fastener.

FIG. 1 illustrates a cutting tool 10 coupled to a fastener such as, but not limited to, a tie wrap 12, extending about at least one wire 13. In the exemplary embodiment, tie wrap 12 includes a strap 14 having a securing mechanism 16 formed integrally therewith and extending across a lateral axis 18 and a longitudinal axis 20 of strap 14 between side 17 and side 19 of strap 14. Strap 14 has a pre-determined thickness 22 defined between a top surface 24 and a bottom surface 26. A distal end (not shown) of tie wrap 12 is passed through an opening 27 formed in securing mechanism 16. Mechanism 16 includes a tab (not shown) that engages teeth (not shown) spread along length of strap 14. Tab engages successive teeth as strap 14 is pulled, under tension, through securing mechanism 16 to bundle wires 13 together.

Figure 2:
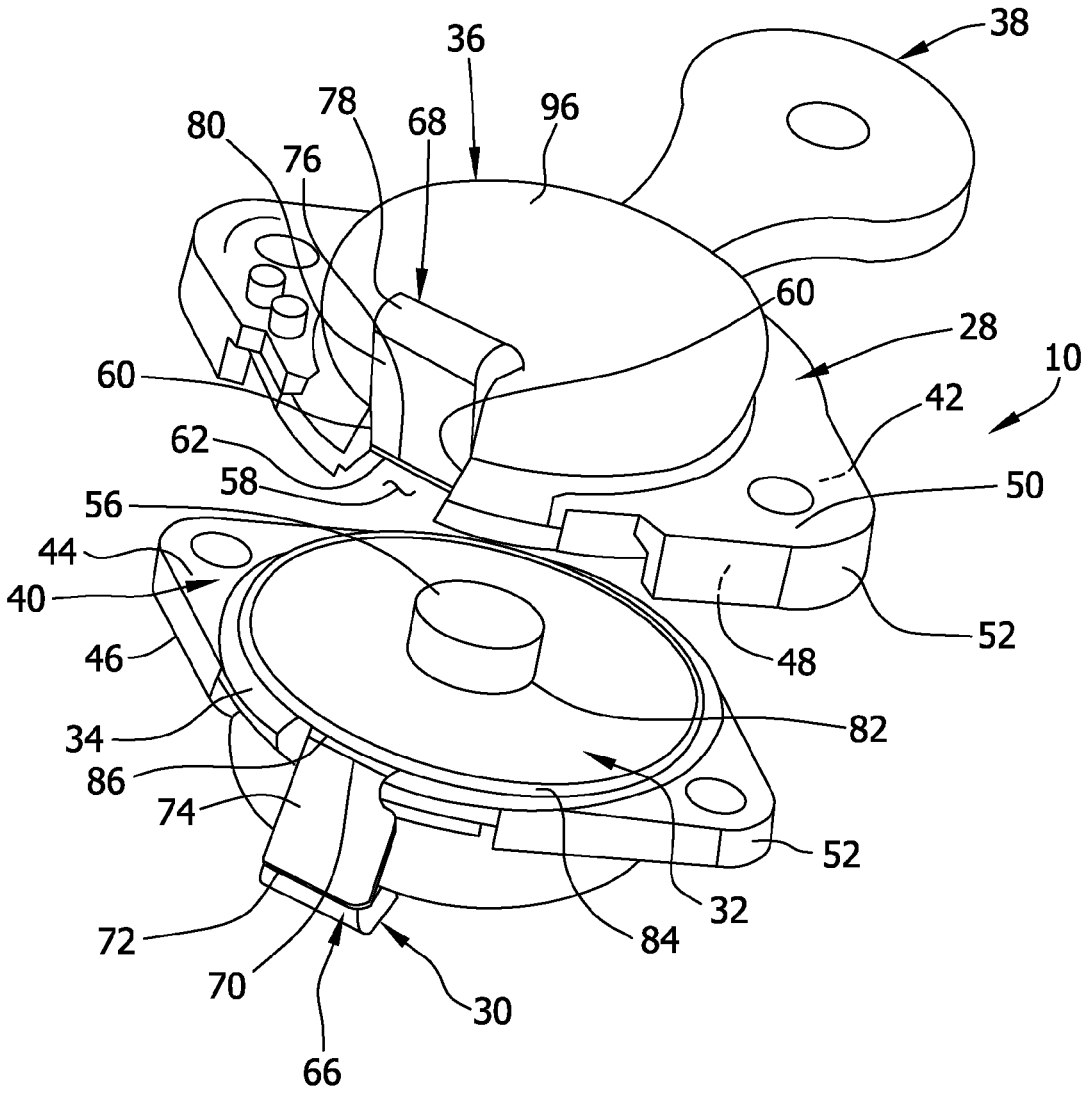
FIG. 2 illustrates a perspective, disassembled view of the cutting tool shown in FIG. 1.
Figure 3:
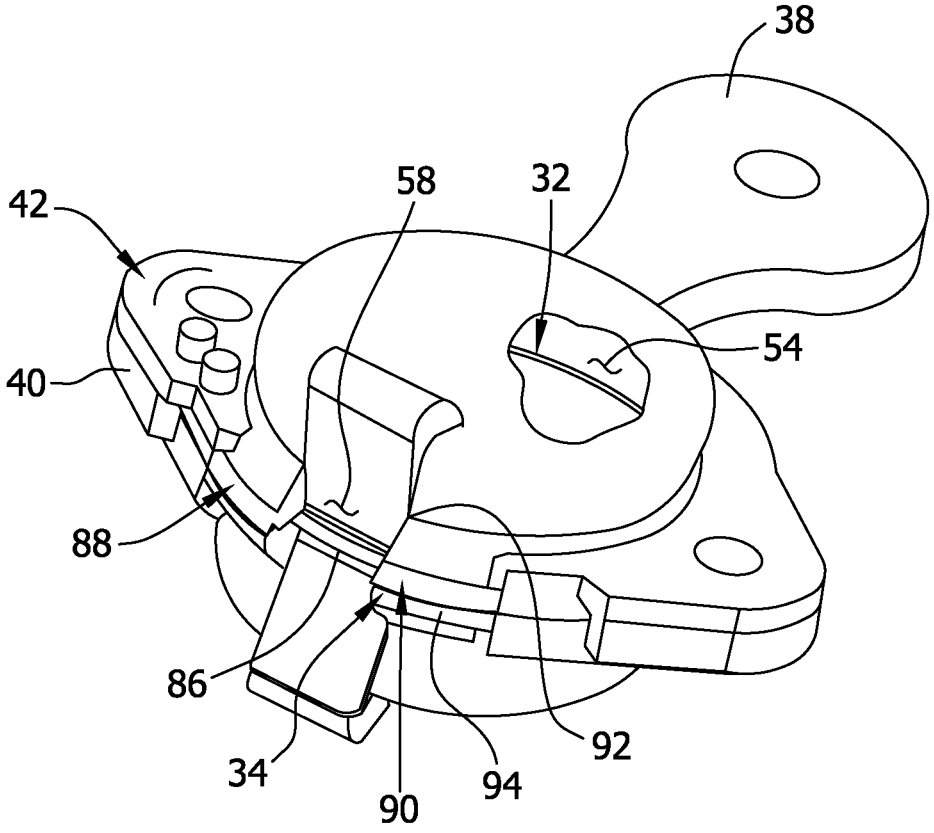
FIG. 3 illustrates a perspective, assembled view of the cutting tool shown in FIG. 2.

FIG. 2 illustrates a perspective, disassembled view of cutting tool 10. FIG. 3 illustrates a perspective, assembled view of cutting tool 10. In the exemplary embodiment, tool 10 at least partially cuts tie wrap 12 (shown in FIG. 1) to facilitate removing tie wrap 12 from wire 13 (shown in FIG. 1). More specifically, to facilitate maximizing its effectiveness, tool 10 cuts tie wrap 12 without damaging wire 13 and without injury to the user (not shown). Tool 10 includes a housing 28, an alignment guide 30, a blade 32, a spacer 34 and a handle 36. In the exemplary embodiment, tool 10 also includes a lanyard connector 38.

Housing 28 contains blade 32, while positioning handle 36 to enable cutting procedures. Housing 28 includes a first side 40 and a second side 42. First side 40 includes an inner portion 44 and an outer portion 46, and second side 42 includes an inner portion 48 and an outer portion 50. First and second sides 40 and 42 respectively each include flanges 52 that are sized and shaped to facilitate coupling first side 40 and second side 42 together. As illustrated in FIG. 3, when coupled together, first side 40 and second side 42 define an interior cavity 54 that is sized to at least partially house blade 32.

Either first side 40 and/or second side 42 includes a blade axle 56. In the exemplary embodiment, blade axle 56 is coupled to inner portion 44 and extends outward therefrom. Further, in the exemplary embodiment, blade axle 56 is circular-shaped to facilitate coupling to blade 32. Alternatively, blade axle 56 may have any shape that enables blade 32 to function as described herein.

In the exemplary embodiment, housing 28 includes at least one groove 58 formed within first side 40 and second side 42. To facilitate positioning of tool 10, relative to tie wrap strap 14, groove 58 is configured to align housing 28 about strap 14 (shown in FIG. 1) and to facilitate controlling alignment and depth of blade 32 during cutting procedures. Groove 58 is defined by opposing side walls 60 and an end wall 62 that extends between side walls 60. Groove 58 is oriented and sized in flow communication with interior cavity 54. In one embodiment, side wall 60 of groove 58 has a plurality of lengths. The length of side wall 60 is variably selected to accommodate different strap thicknesses 22 (shown in FIG. 1) when housing 28 is coupled to strap 14 as described herein. Groove 58 can be sized and shaped to accommodate housing 28 about different sized straps 14. Any shape and size of groove 58 may be used that enables tool 10 to function as described herein.

Alignment guide 30 is coupled to housing 28 and extends outward from groove 58 to enable aligning blade 32 with tie wrap 12 (shown in FIG. 1) during a cutting process. In the exemplary embodiment, alignment guide 30 includes a first guide member 66 and a second guide member 68. First guide member 66 is coupled to first side 40 and extends laterally outward from first side 40. In the exemplary embodiment, first guide member 66 includes an end 70 that is coupled to housing 28 and an opposite end 72 that is a distance away from housing 28. A side 74 extends between end 70 and end 72, wherein side 74 is sized and shaped to couple to strap 14 (shown in FIG. 1).

Second guide member 68 is coupled to second side 42 and extends laterally outward from second side 42. In the exemplary embodiment, second guide member 68 includes an end 76 that is coupled to housing 28 and an opposite end 78 positioned away from housing 28. Second guide member 68 has a side 80 that extends between end 76 and end 78, wherein side 80 is sized and shaped to couple to strap 14 (shown in FIG. 1).

Blade 32 is coupled to blade axle 56 and positioned within cavity 54 to enable at least a portion of tie wrap 12 (shown in FIG. 1) to be at least partially cut as described herein. Blade 32 includes an inner mounting surface 82 and an outer cutting surface 84. Inner mounting surface 82 is coupled to blade axle 56. In one embodiment, inner surface 82 is rotatably coupled to blade axle 56. Blade 32 is rotatably coupled to blade axle 56 to facilitate increasing usable cutting surface 84 to improve blade life by allowing the entire cutting surface 84 to be rotatably used during cutting processes. As illustrated in FIG. 3, a portion 86 of outer cutting surface 84 extends into groove 58. In one exemplary embodiment, blade 32 is a circular-shaped blade having a diameter of between about 10 mm (40 in.) to about 40 mm (1.6 in.). In the exemplary embodiment, blade 32 has a diameter of about 28 mm. In another exemplary embodiment, blade has a diameter of about 40 mm. Blade 32 is variably selected to have a size that accommodates at least partially cutting a plurality of different sized tie straps 14. Any size blade 32 may be used that enables tool 10 to function as described herein.

Spacer 34 is coupled to housing 28 to facilitate protecting wire 13 (shown in FIG. 1) from damage by blade 32. In the exemplary embodiment, spacer 34 radially extends outward from housing 28. More specifically, spacer 34 contacts, moves and maintains wire 13 a distance away from blade 32 during cutting procedures. Spacer 34 includes a first portion 88 and a second portion 90, wherein housing groove 58 is between first portion 88 and second portion 90. In the exemplary embodiment, spacer 34 is sized to extend beyond the exposed portion 86 of blade cutting surface 84. Blade cutting portion 86 is recessed within groove 58 to facilitate limiting exposure of cutting portion 86 to wire 13 (shown in FIG. 1). During cutting processes as described herein, spacer 34 is configured to protect wire 13 and the user from contact with exposed cutting portion 86.

Spacer 34 includes an end 92 that is coupled to housing 28 and includes an end 94 that is positioned a radial distance away from groove 58. In the exemplary embodiment, spacer 34 is wedge-shaped. In alternative embodiments, spacer 34 can have any other shapes such as, but not limited to, round shapes and triangular shapes. Further, spacer 34 can include a plurality of lengths to facilitate variable selection to accommodate strap thickness 22 (shown in FIG. 1). Moreover, the length of spacer 34 is sized to accommodate for contacting and moving wire 13 when housing 28 is applied to strap 14. Any size and shape of spacer 34 may be used that enables tool 10 to function as described herein.

Handle 36 is coupled to housing 28 to facilitate ergonomic use of tool 10. Handle 36 includes at least one surface 96 that is coupled to at least one of first side 40 and to second side 42. In the exemplary embodiment, surface 96 has a generally cylindrical shape which facilitates the tool 10 being held by the user's hand. Surface 96 may include other shapes such as, but not limited to, ridge shapes. Any shape of handle surface 96 may be used that enables tool 10 to function as described herein. Lanyard connector 38 is coupled to housing 28 and to a retractable lanyard (not shown) so that the user can conveniently wear tool 10 such as, for example, by wearing tool 10 around the user's neck (not shown) and/or by connecting with a belt (not shown).

Figure 4:
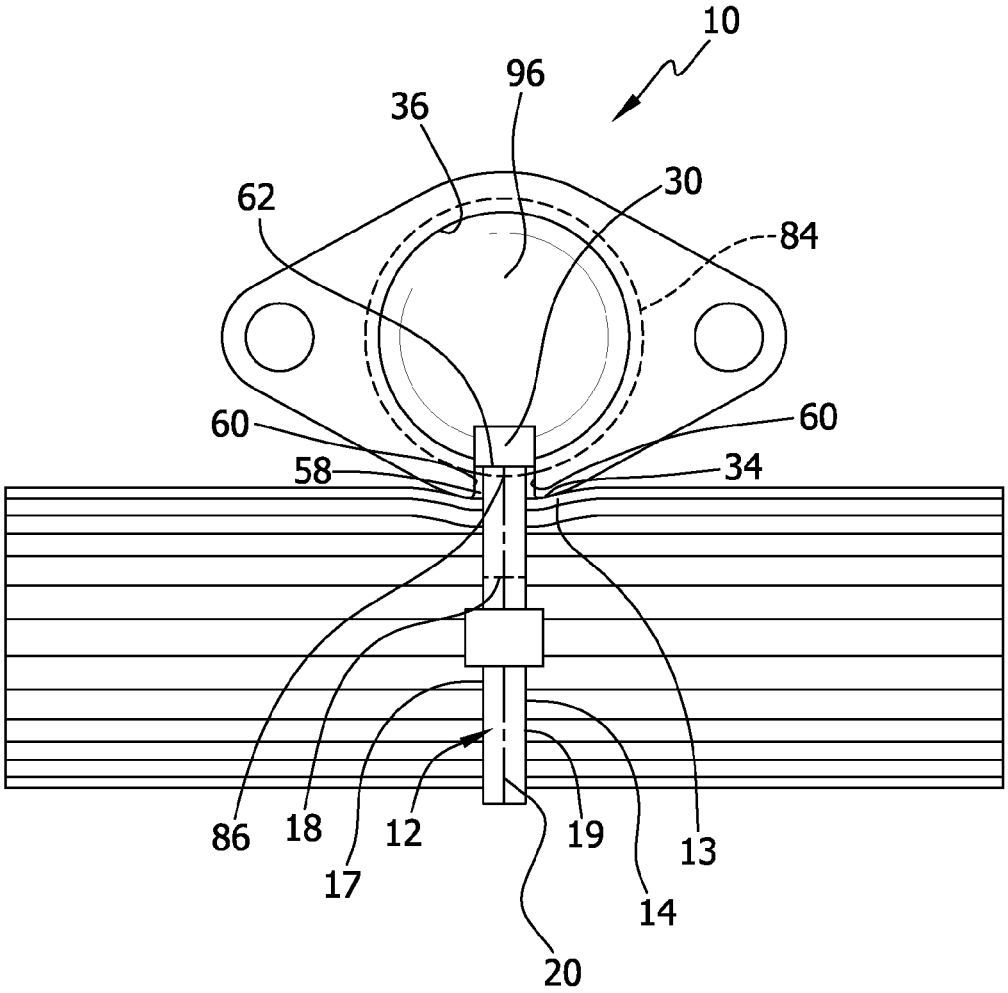
FIG. 4 illustrates a side view of the cutting tool shown in FIG. 1 and coupled to the fastener.

FIG. 4 illustrates a side view of tool 10 coupled to tie wrap strap 14. In an exemplary embodiment, a user (not shown) grasps handle 36 to operate tool 10 for one-handed operation. More specifically, during use, the user grasps surface 96 of handle 36 within the user's hand. In alternative modes, user can manipulate handle 36 with another tool (not shown). The user moves tool 10 towards strap 14 extending about tie wrap 12. Moreover, the user applies housing 28 against tie wrap 12. In one embodiment, as user moves tool 10 towards tie wrap 12, tool 10 remains coupled to the retractable lanyard (not shown). Thus, if the user drops tool 10, tool 10 remains connected to lanyard. As the user moves tool 10, the user aligns groove 58 about strap 14 such that opposing side walls 60 of groove 58 are positioned on opposite sides 17 and 19 of strap 14. Further, alignment guide 30 is coupled to surface 24 of strap 14. The user continues to move housing 28 until groove 58 is positioned about strap 14 and alignment guide 30 is coupled to strap 14. In the exemplary embodiment, alignment guide 30 couples to strap 14 along longitudinal axis 20 of strap 14. Further, in the exemplary embodiment, at least one sidewall 60 of groove 58 couples to strap 14 along lateral axis 18 of strap 14.

Because spacer 34 extends beyond housing 28, alignment guide 30 and blade 32, as groove 58 is positioned about strap 14, end 94 of spacer 34 is coupled to wire 13 to facilitate moving wire 13 a distance away from strap 14 and maintaining wire 13 away from strap 14. In the exemplary embodiment, the wedge shape of spacer 34 burrows in-between individual wires 13 to facilitate creating a space such as a pocket between wire 13 and strap 14. Further, when alignment guide 30 and groove 58 are coupled to strap 14, the exposed portion 86 of cutting surface 84 is coupled to strap top surface 24. The user then continues to move handle 36 to position exposed cutting portion 86 against strap top surface 24. In one mode of operation, user reciprocally rotates handle 36 about strap 14 to apply exposed cutting portion 86 against strap 14. In another mode of operation, user reciprocally slides handle 36 across strap 14 to apply exposed cutting portion 86 against strap 14. Moreover, because cutting portion 86 is exposed into groove 58, and spacer 34 maintains wire 13 away from strap 14 spacer 34 and groove 58 facilitate minimizing or preventing cutting portion 86 from contacting wire 13.

As cutting surface 84 cuts strap 14, alignment guide 30, pacer 34 and groove 58 facilitate aligning and controlling the depth of cutting surface 84. More particularly, cutting surface 84 is prevented from penetrating into strap 14 beyond the exposed cutting portion 86 of cutting surface 84. Thus, the sizes, shapes and orientations of at least spacer 34, groove 58 and alignment guide 30 facilitate controlling the depth of cutting surface 84 to prevent exposed portion 86 form contacting wire 13. More particularly, spacer 34 maintains wire 13 away from strap 14 to facilitate minimizing or preventing exposed cutting portion 86 from contacting wire 13.

Because strap 14 is applied around wire 13 under tension, at least partially cutting strap 14 with exposed cutting portion 86 enables a user to easily break strap 14 to free wires 13. More particularly, often the tension force induced to strap 14 causes strap 14 to break as the exposed cutting portion 86 at least partially cuts strap 14 Moreover, exposed cutting portion 86 applies cutting force to strap 14 that is positioned within groove 58 to facilitate reducing force required to cut strap 14. During operation, tool 10 facilitates providing a tactile feedback to the user and provides for one-handed operation in hard to reach or hard to see areas. Additionally, because spacer 34 extends beyond housing 28, exposed cutting portion 86 is recessed within groove 58 to facilitate minimizing or preventing user contact with exposed cutting portion 86 such that injury to the user is prevented.

Figure 5:
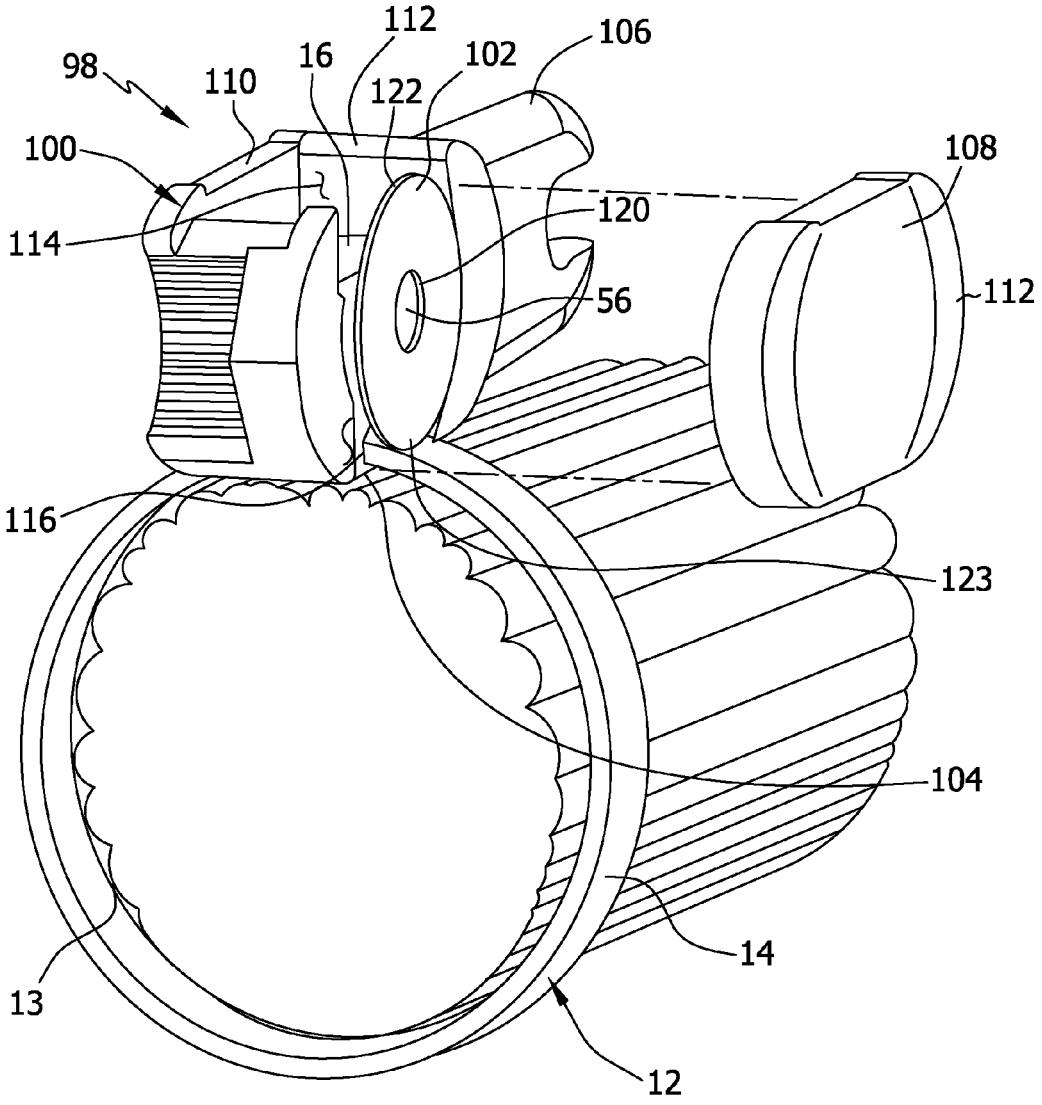
FIG. 5 illustrates a perspective view of an alternative cutting tool that may be used to cut the fastener shown in FIG. 1.

FIG. 5 illustrates a perspective view of an alternative cutting tool 98 that may be used to cut tie wrap 12. Moreover, in FIG. 5, the same reference numerals are illustrated to indicate identical components previously described. Tool 98 includes a housing 100, a blade 102, a spacer 104, and a handle 106. In FIG. 5, for simplicity, a portion of housing 100 is removed.

Housing 100 contains blade 102, while positioning handle 106 to enable cutting procedures. Housing 100 includes a first side 108 and a second side 110. First and second sides 108 and 110 respectively each include flanges 112 that are sized and shaped to facilitate coupling first side 108 and second side 110 together. When coupled together, first side 108 and second side 110 define an interior cavity 114 that is sized to at least partially house blade 102. Further, in the exemplary embodiment, interior cavity 114 is sized and shaped to accept securing mechanism 16 of tie wrap 12 within housing 100.

In an exemplary embodiment, housing 100 includes at least one groove 116 formed within first side 108 and second side 110, wherein groove 116 is in flow communication with interior cavity 114. To facilitate positioning of tool 98 relative to tie wrap strap 14, groove 116 is configured to align housing 100 about strap 14 to facilitate cutting procedures as described herein.

Blade 102 is coupled to blade axle 56 that is coupled to either first side 108 or second side 110 to enable at least a portion of tie wrap 12 to be at least partially cut as described herein. Blade 102 includes an inner mounting surface 120 and an outer cutting surface 122, wherein inner mounting surface 120 is coupled to blade axle 56. As illustrated in FIG. 5, a portion 123 of outer cutting surface 122 extends into groove 116.

Spacer 104 is coupled to housing 100 to facilitate protecting wire 13 from damage by blade 102. More specifically, spacer 104 moves wire 13 away from blade 102 and maintains wire 13 away from blade 102 during cutting operations. In the exemplary embodiment, spacer 104 is coupled to housing 100 and extends outward from housing 100. In the exemplary embodiment, spacer 104 extends beyond exposed portion 123 of cutting surface 122. Spacer 104 is sized and shaped to couple to wire 13 and maintain wire 13 a distance away from cutting surface 122 during cutting procedures as described herein.

In an exemplary embodiment, a user (not shown) grasps handle 106 to operate tool 98 to facilitate cutting strap 14 adjacent and/or around securing mechanism 16. The user moves tool 98 toward strap 14. More particularly, during use, user moves tool 98 toward securing mechanism 16 of tie wrap 12. As the user moves tool 98, the user aligns groove 116 about securing mechanism 16 and about strap 14. The user continues to move tool 98 to position about strap 14 until securing mechanism 16 is positioned within cavity 114.

Because spacer 104 extends beyond housing 100, as groove 116 is positioned about strap 14, spacer 104 is coupled to wire 13 to facilitate moving and maintaining wire 13 away from strap 14. Further, when groove 116 couples to strap 14, exposed portion 123 of cutting surface 122 is coupled to strap 14. The user then moves handle 106 to position blade cutting surface 122 against strap 14. In one mode of operation, user reciprocally slides handle 106 about strap 14 to apply cutting surface 122 against strap 14.

As cutting surface 122 cuts strap 14, at least spacer 34, groove 116 and cavity 114 control the depth of cutting surface 122 into strap 14. Thus, the sizes, shapes and orientations of at least spacer 34, groove 116 and cavity 114 facilitate controlling depth of cutting surface 122 into strap 14. More particularly, the depth control provided by at least spacer 34, groove 116 and cavity 114 facilitates preventing cutting surface 122 from inadvertently cutting through strap 14 and contacting wire 13.

Figure 6:
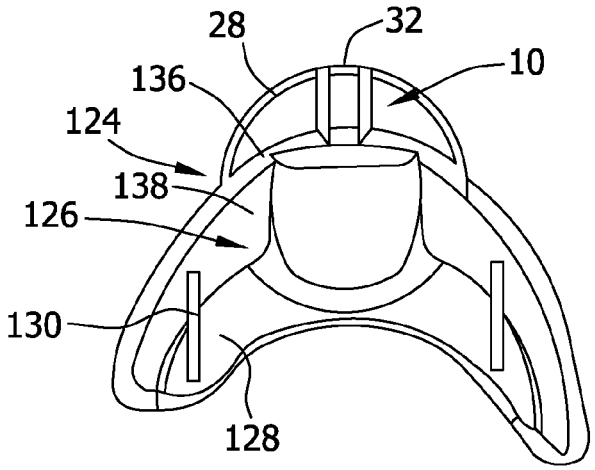
FIG. 6 illustrates a perspective view of an alternative handle that may be used with the cutting tool shown in FIG. 1.

FIG. 6 illustrates a perspective view of an alternative handle 124 that may be used with tool 10. Moreover, in FIG. 6, the same reference numerals are used to indicate identical components previously described. Handle 124 couples to housing 28 to facilitate handling and operating tool 10. In the exemplary embodiment, handle 124 includes a flange 126, a base 128 and a fastener 130.

Flange 126 includes a first side 136 and a second side 138. First side 136 is coupled to housing 28, and second side 138 is coupled to base 128. In the exemplary embodiment, flange 126 has an arcuate shape to facilitate ergonomic handling by the user. Flange 126 may have any shape that enables operation of tool 10 as described herein. Fastener 130 is coupled to base 128 and to flange 126, and extends between base 128 and flange 126. In the exemplary embodiment, fastener 130 is a bias-able strap that is extended, under tension, between base 128 and flange 126. A user's finger (not shown), such as a thumb, can engage fastener 130 to facilitate handling tool 10.

In the exemplary embodiment, the user extends a thumb (not shown) under fastener 130 and between base 128 and flange 126. As a force is applied by fastener 130 against the finger, the user may carry tool 10 on their finger during cutting procedures and during non-cutting procedures. During an exemplary cutting procedure, the user can also grasp the flange 126 with their other fingers or palm to further manipulate housing 28. Once the user has grasped handle 124, the user can selectively position handle 124 to align tool 10 with strap (not shown) and to at least partially cut strap during one-handed operation as previously described.

Figure 7:
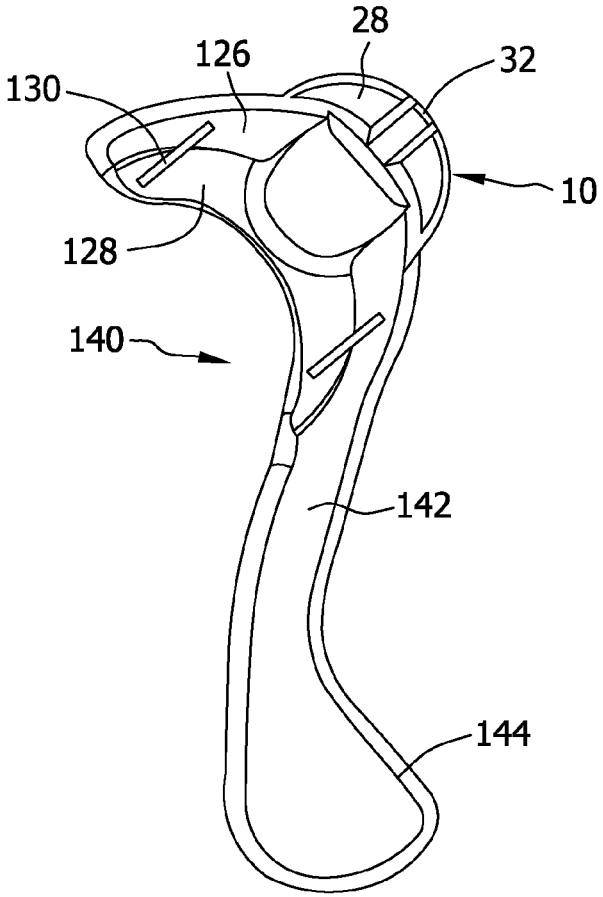
FIG. 7 illustrates a perspective view of an alternative handle that may be used with the cutting tool shown in FIG. 1.

FIG. 7 illustrates a perspective view of an alternative handle 140 that may be used with tool 10. Moreover, in FIG. 7, the same reference numerals are used to indicate identical components previously described. Handle 140 includes an arm 142 coupled to flange 126 wherein arm 142 is configured to provide leverage support to the user during cutting operations. Moreover, arm 142 is configured to facilitate one-handed operation of tool 10. In the exemplary embodiment, arm 142 includes a rounded end 144 which is configured to facilitate ergonomic handling by the user. End 144 may have any shape that enables operation of tool 10 as described herein. In an exemplary embodiment, the user inserts a finger (not shown) under fastener 130 and between flange 126 and base 128 as previously described. The user then grasps arm 142 with their fingers. When user applies cutting motion for blade 32, arm 142 maximizes one-handed operation. Arm or handle 142 facilitates control by allowing the user to grasp handle 142 with their pinky and ring finger. Other fingers can be used to wrap around bundled wires 13 (shown in FIG. 1) and pull strap 14 to couple with blade 32 to facilitate cutting strap 14 (shown in FIG. 1).

Figure 8:
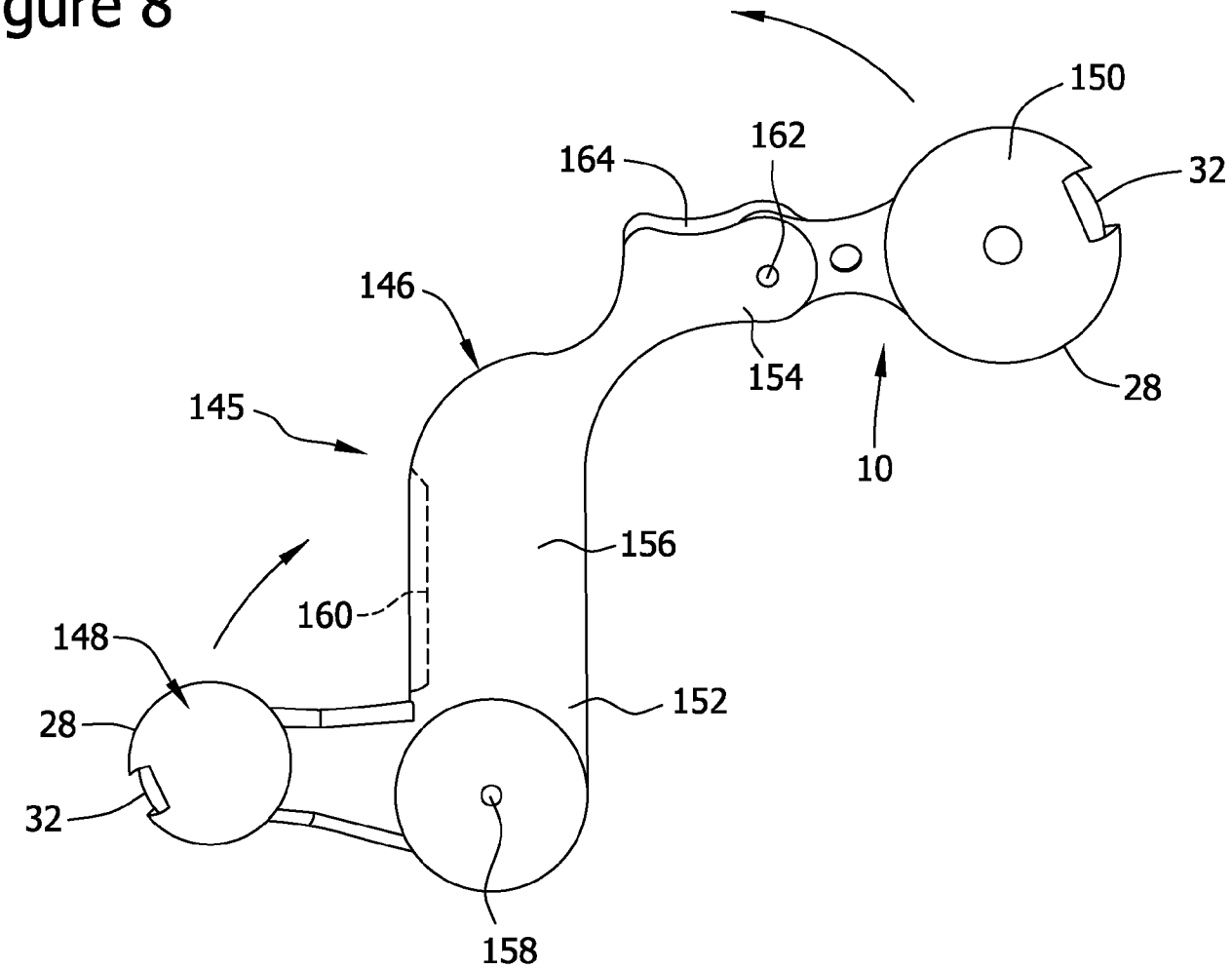
FIG. 8 illustrates a side view of an alternative handle in an open position that may be used with the cutting tool shown in FIG. 1.
Figure 9:
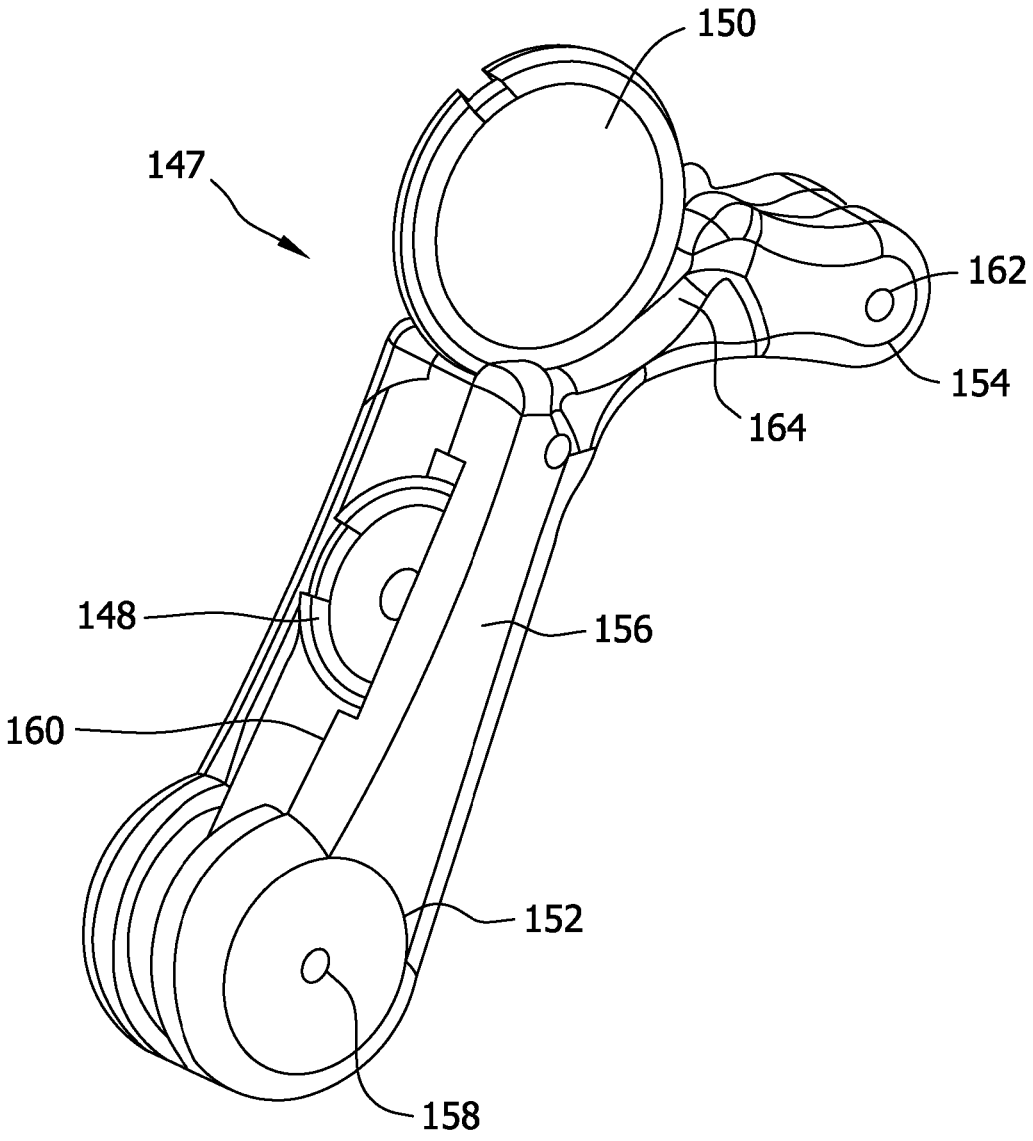
FIG. 9 illustrates a perspective view of the alternative handle shown in FIG. 8 in a closed position.

FIG. 8 illustrates a perspective view of an alternative handle 146 in an open position 145 that may be used with tool 10. FIG. 9 illustrates a perspective view of alternative handle 146 (shown in FIG. 8) in a closed position 147. Moreover, in FIGS. 8 and 9, the same reference numerals are used to indicate identical components previously described. Tool 10 includes a first tool 148 and a second tool 150. In the exemplary embodiment, first tool 148 and second tool 150 are removably coupled to handle 146. Further, in the exemplary embodiment, first tool 148 and second tool 150 are rotatably coupled to handle 146. First tool 148 includes a smaller housing 28 and blade 32 as compared to second tool 150. The different sizes of tool 148 and tool 150 maximize efficiency for cutting differently sized straps 14 (shown in FIG. 1). Moreover, the different sizes of tool 148 and tool 150 facilitate cutting strap 14 in hard to reach or hard to see areas.

Handle 146 includes a first end 152, a second end 154 and an arm 156 extending between first end 152 and second end 154. First end 152 includes a first pivot portion 158 that is coupled to first tool 148. In an embodiment, first pivot portion 158 is configured to rotatably couple to first tool 148. First end 152 further includes a first groove 160 formed therein. First groove 160 is sized and shaped to at least partially receive first tool 148 when first tool 148 is rotated to closed position 147 as illustrated in FIG. 9. In the exemplary embodiment, first tool 148 is removably coupled to first end 152. Second end 154 includes a second pivot portion 162 that is configured to couple to second tool 150. In an embodiment, second pivot portion 162 is configured to rotatably couple to second tool 150. Second end 154 further includes a second groove 164 formed therein. Second groove 164 is sized and shaped to at least partially receive second tool 150 when second tool 150 is rotated to closed position 147 as illustrated in FIG. 9. In the exemplary embodiment, second tool 150 is removably coupled to second end 154. Moreover, in an embodiment, first tool 148 and second tool 150 are removably coupled to either first end 152 or second end 154.

Figure 10:
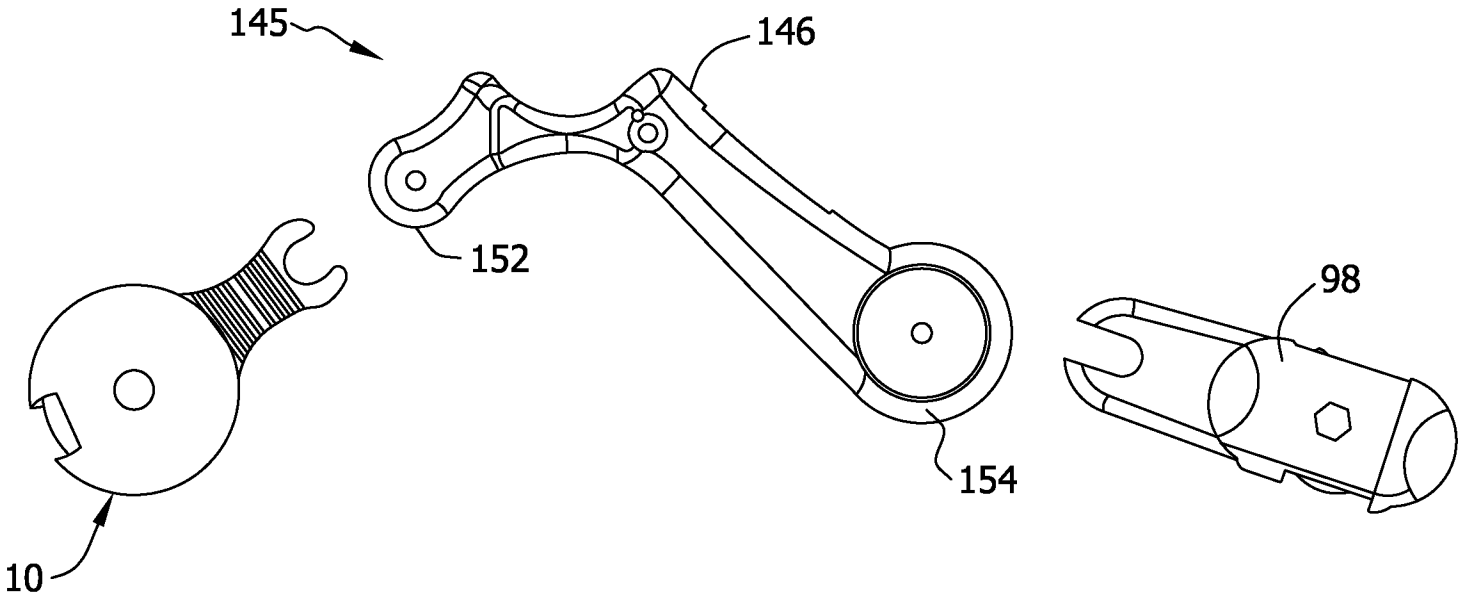
FIG. 10 illustrates a side view of the handle shown in FIG. 8 in a disassembled state.

FIG. 10 illustrates a perspective view of alternative handle 146 (shown in FIGS. 8 and 9) that may be used with cutting tool 10 (shown in FIG. 1) and cutting tool 98 (shown in FIG. 5), tool 10 and tool 98 shown disassembled from handle 146. Moreover, in FIG. 10, the same reference numerals are used to indicate identical components previously described. As illustrated, first end 152 is removably coupled to cutting tool 10, and second end 154 is removably coupled to cutting tool 98. First end 152 and second end 154 provide selective interchangeability of a plurality of tools 10 and 98 to facilitate cutting procedures for a different sized straps (not shown).

Figure 11:
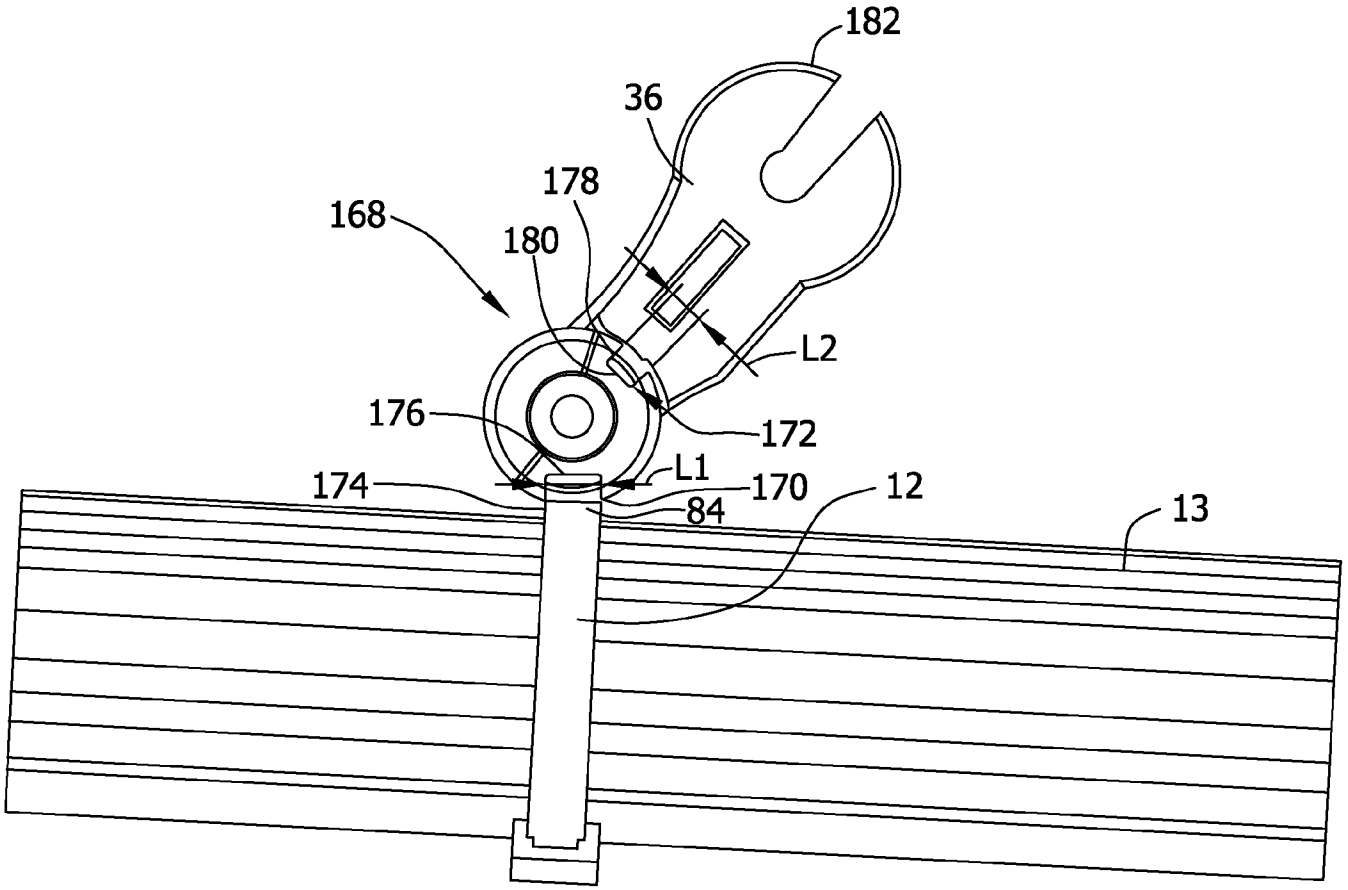
FIG. 11 illustrates a side view of an alternative exemplary cutting tool that may be used to cut a fastener.
Figure 12:
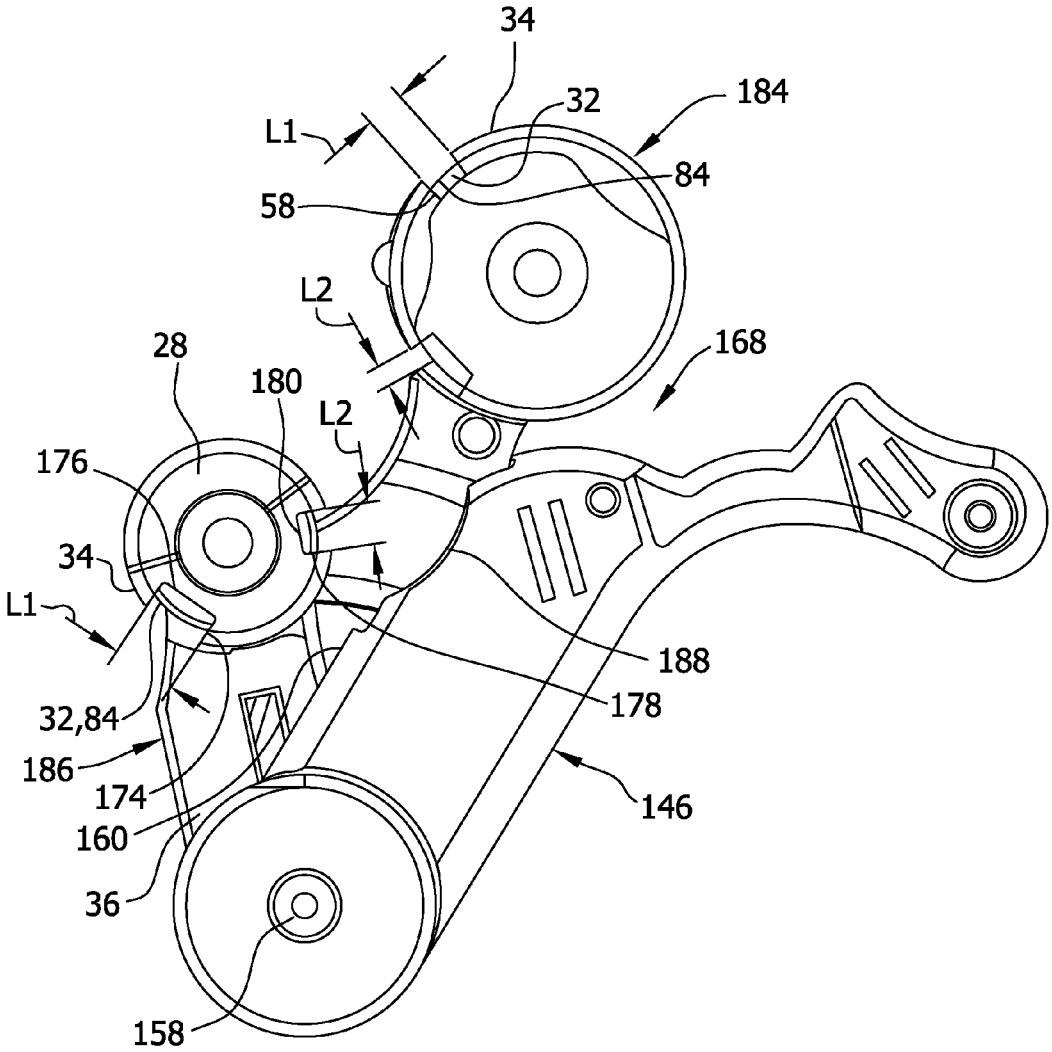
FIG. 12 illustrates a side view of the cutting tool shown in FIG. 11 coupled to the handle shown in FIG. 8.
Figure 13:
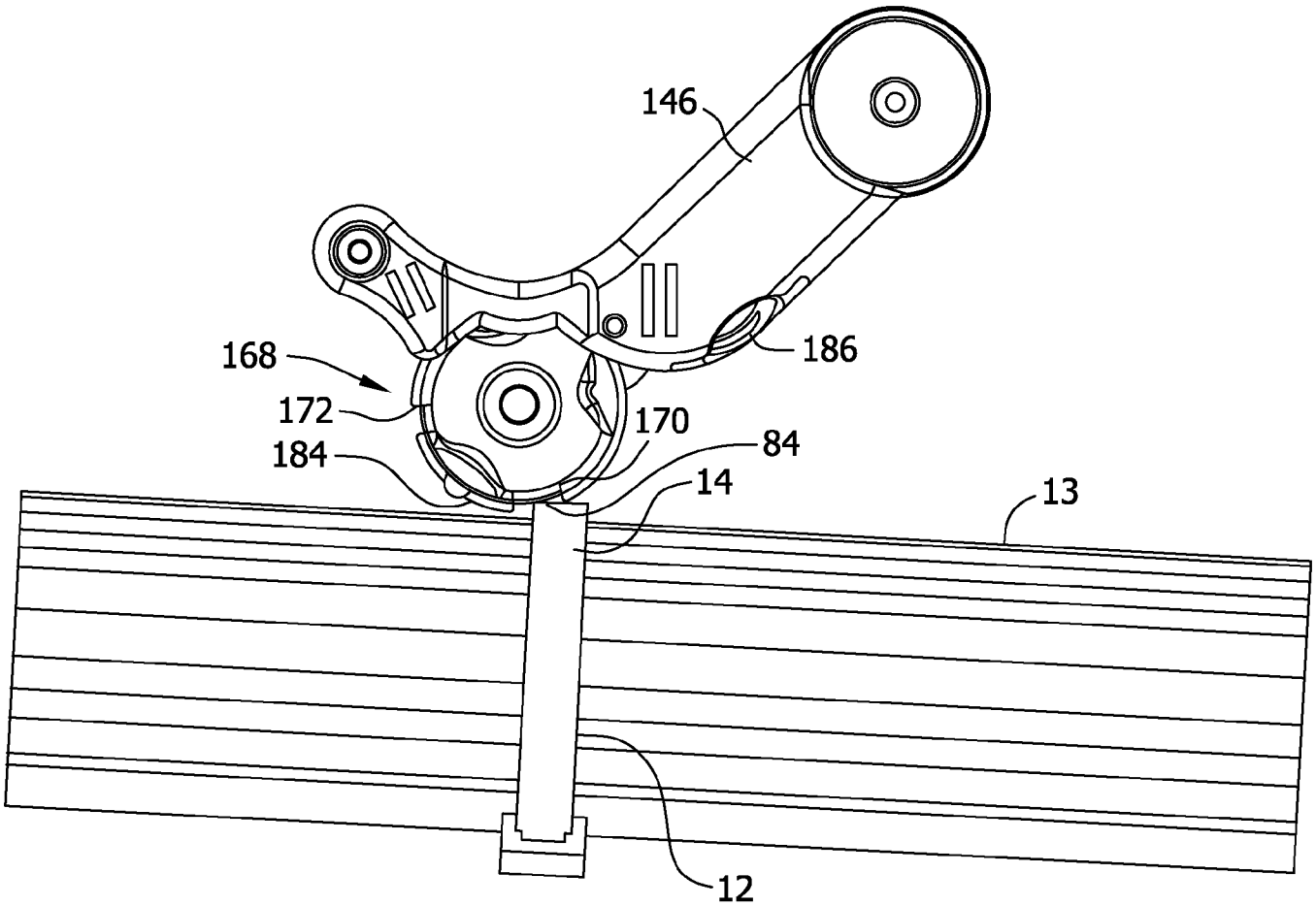
FIG. 13 illustrates a side view of cutting tool and handle shown in FIG. 12 that may be used to cut a fastener.

FIG. 11 illustrates an alternative cutting tool 168 that may be used to cut tie wrap 12. FIG. 12 illustrates cutting tool 168 coupled to handle 146. FIG. 13 illustrates tool 168 and handle 146 coupled to strap 14. Moreover, in FIGS. 11, 12 and 13, the same reference numerals are illustrated to include identical components previously described.

Tool 168 includes at least housing 28, blade 32, spacer 34, handle 36 and groove 58 as previously described. In the exemplary embodiment, at least one groove 58 of housing 28 includes a first groove 170 and a second groove 172 which are in flow communication with cavity (not shown). As illustrated, cutting surface 84 of blade 32 extends into first groove 170 and second groove 172. First groove 170 is defined by opposing sidewalls 174 and end wall 176 that extends between sidewalls 174. Second groove 172 is defined by opposing sidewalls 178 and end wall 180 that extends between sidewalls 178. First end wall 176 has a length L1 that is longer than a length L2 of second end wall 180. First groove 170 and second groove 172 are sized and shaped to accommodate cutting differently sized straps 14. More particularly, first groove 170 and second groove 172 are differently sized to provide selective interchangeability for the user (not shown) to at least partially cut different sized straps 14 by using single tool 168. Moreover, first groove 170 and second groove 172 include different sizes to facilitate accessing tie strap 14 in hard to reach or hard to see areas.

In the exemplary embodiment, tool 10 is rotatably coupled to handle 146 to facilitate moving and aligning at least first groove 170 and second groove 172 about strap 14. Handle 36 includes an end 182 that is sized and shaped to removably couple with another handle such as, but not limited to, handle 146 (shown in FIG. 12). First groove 170 and second groove 172 are formed to facilitate exposing cutting surface 84 to tie wrap strap 14. During use, first groove 170 and second groove 172 are coupled to tie wrap strap 14 to facilitate aligning cutting surface 84 into tie wrap strap 14.

In the exemplary embodiment, end 182 is sized and shaped to rotatably couple to handle 146. As illustrated in FIG. 12, tool 168 includes at least a first tool 184 and a second tool 186 that are coupled to handle 146. First tool 184 includes a larger housing 28 and blade 32 as compared to second tool 186. The different sizes of tool 184 and tool 186 maximize efficiency for cutting differently sized straps and maximize efficiency for accessing hard to reach or hard to see areas.

In the exemplary embodiment, pivot portion 158 and groove 160 of handle 146 are configured to provide selective adaptability for the user (not shown) to select first tool 184 or second tool 186 and to rotatably move selected first tool 184 or second tool 186 out of groove 160 to cut tie wrap strap 14 as previously described. Moreover, first tool 184 and second tool 186 are configured to removably couple to handle 146 to provide selective adaptability for the user to remove either tool 184 and 186 from handle 146 for use in hard to reach or hard to see areas. As illustrated, handle 146 includes a finger cut-out 188 that is configured to provide access to the user to facilitate rotatably moving at least first tool 184 and second tool 186 out of groove 160.

Figure 14:
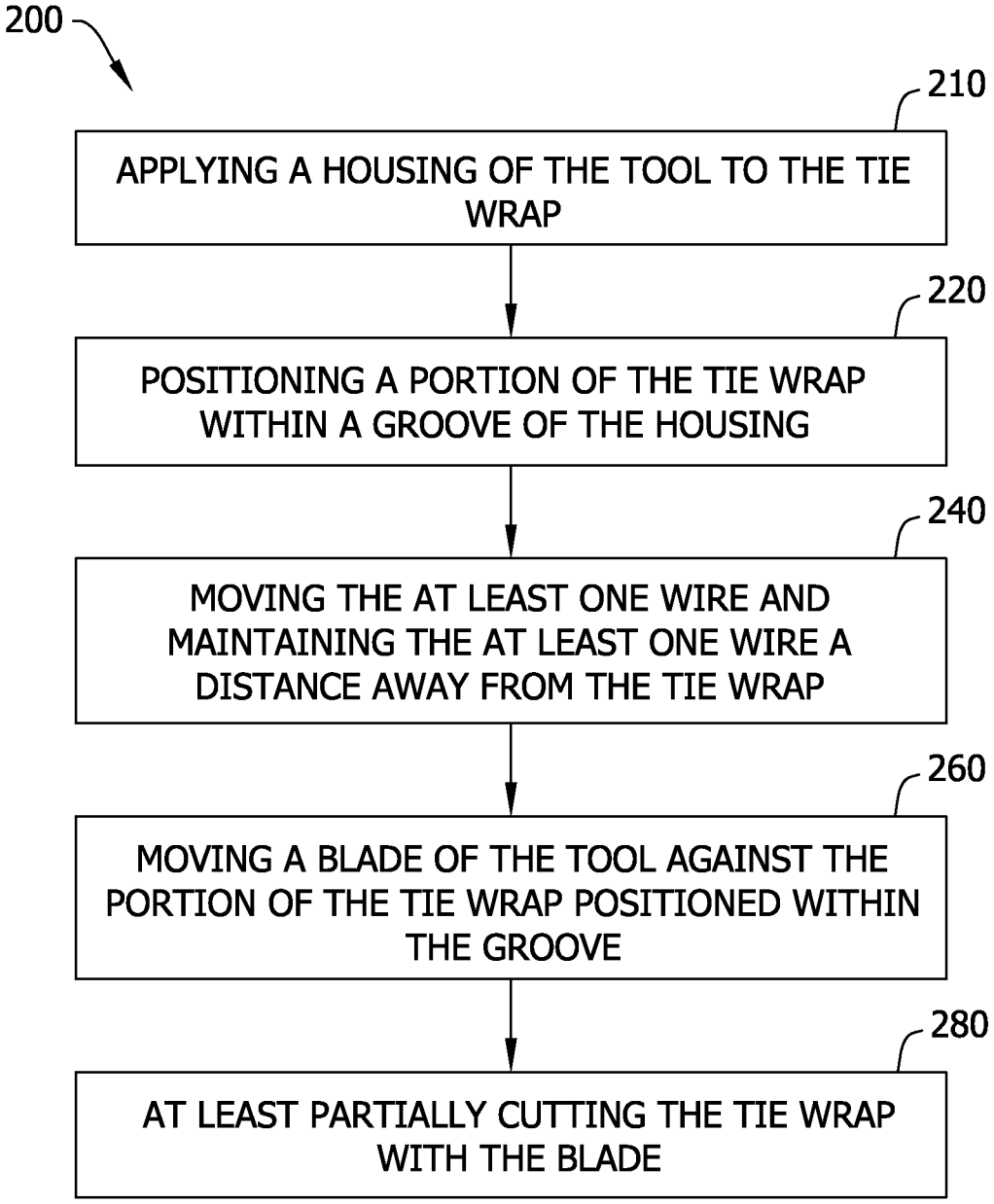
FIG. 14 illustrates a flowchart of an exemplary method of operating a cutting tool.

FIG. 14 is a flowchart illustrating an exemplary method 200 of operating a tool, for example tool 10 (shown in FIG. 1), for use in cutting a fastener (for example tie wrap 12 shown in FIG. 1) bound about at least one wire, for example wire 13 (shown in FIG. 1). Method 200 includes applying 210 a housing, such as housing 28 (shown in FIGS. 1 and 2), of the tool to the tie wrap. The method further includes positioning 220 a portion of the tie wrap within a groove, for example groove 58 (shown in FIG. 2) of the housing. A spacer, such as spacer 34 (shown in FIGS. 1 and 2) moves 230 the at least one wire and maintains the at least one wire a distance away from the tie wrap. Method 200 further includes moving 240 a blade, such as blade 32 (shown in FIGS. 1 and 2) of the tool against the portion of the tie wrap positioned within the groove. Method also includes at least partially cutting 250 the tie wrap with the blade.

The subject matter described herein relates generally to cutting tools and, more particularly, to cutting tools for use in cutting tie wraps to free objects (e.g., wires) bound by a fastener (e.g., tie wraps). The tool includes a groove and guide member that are selectively positionable to facilitate aligning a blade to control the depth of the blade into the tie wrap during cutting procedures. The tool also includes a spacer that prevents inadvertent blade contact with the wires bound by the tie wrap. As such, use of the tool described herein facilitates increasing the reliability and/or efficiency of cutting a tie wrap without damaging a wire and without injuring the user.

Exemplary embodiments of systems and methods for using a cutting tool are described above in detail. The systems and methods are not limited to the specific embodiments described herein, but rather, components of systems and/or steps of the method may be utilized independently and separately from other components and/or steps described herein. The disclosed dimensional ranges include all sub ranges there between. Further, tool may be fabricated from any material that enables tool to function as described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A tool for use in cutting a tie wrap bound about at least one wire, the tool comprising:

a housing, comprising a first side and a second side, wherein:

the first side and the second side are coupled together to define a cavity, the first side comprises first two opposing side walls and a first end wall, extending therebetween and perpendicular to each of the first two opposing sidewalls, the second side comprises second two opposing sidewalls and a second endwall, extending therebetween and perpendicular to each of the second two opposing sidewalls, the first two opposing side walls, the first end wall, the second two opposing side walls, and the second end wall define a first groove formed in the first side and in the second side, and the first groove is configured to receive a portion of the tie wrap between the first two opposing sidewalls and the second two opposite sidewalls;

an alignment guide, extending outward from the housing, wherein:

the alignment guide comprises a first guide surface and a second guide surface oriented obliquely relative to each other and configured to engage the tie wrap during cutting of the tie wrap, the first guide surface extends from the housing along a first axis, and the second guide surface extends from the housing along a second axis;

a circular blade, rotatably coupled to the first side of the housing and comprising a cutting surface, an inner mounting surface, and a planar side surface, extending between the cutting surface and the inner mounting surface, wherein a portion of the cutting surface of the circular blade extends into the first groove, while a remaining portion of the cutting surface of the circular blade is enclosed within the cavity, the planar side surface of the circular blade is perpendicular to a plane comprising the first axis and the second axis; and a spacer, extending from the housing and configured to contact the at least one wire to maintain the at least one wire a distance away from the cutting surface of the circular blade when the tie wrap extends into the first groove, wherein the spacer comprises a first portion and a second portion such that the first groove is positioned therebetween.

2. The tool according to claim 1, wherein the first guide surface is coupled to the first side and the second guide surface is coupled to the second side.

3. The tool according to claim 1 further comprising a handle coupled to the housing.

4. The tool according to claim 3, wherein the handle comprises a bias-able strap.

5. The tool according to claim 3, wherein the handle has a cylindrical shape.

6. The tool according to claim 3, wherein the handle is rotatably coupled to the housing.

7. The tool according to claim 6, wherein the handle comprises a handle grove for at least partially receiving the housing when the tool is rotated into a closed position.

8. The tool according to claim 1 further comprising a handle removably coupled to the housing.

9. The tool according to claim 1 wherein:

the first side and the second side each comprising two additional opposing sidewalls and an additional end-wall, extending therebetween and perpendicular to each of the two additional opposing sidewalls, to define a second groove formed in the first side and in the second side; and the cutting surface at least partially extends into the second groove such that the cutting surface is simultaneously exposed in the first groove and the second groove.

10. The tool according to claim 9, wherein:

the first groove has a first length;

the second groove has a second length; and the first length is longer than the second length.

11. The tool according to claim 9, wherein the second groove is circumferentially offset relative to the first groove about a venter of the circular blade.

12. The tool according to claim 1, wherein the spacer is wedge shaped.

13. The tool according to claim 1, wherein portions of the first guide surface and the second guide surface are positioned within the first groove between the opposing sidewalls.

14. The tool according to claim 1, wherein the first side of the housing comprises a blade axle, having a circular shape in cross-section, protruding through the circular blade, and contacting the inner mounting surface of the circular blade.

15. The tool according to claim 1, wherein rotating the circular blade relative to the housing exposes a different portion of the cutting surface of the circular blade in the first groove.

16. The tool according to claim 1, wherein the spacer radially extends a length from the housing and away from the circular blade.

17. The tool according to claim 16, wherein the length of the spacer is sized to contact and move the at least one wire when the tie wrap extends into the first groove.

18. The tool according to claim 1, wherein a cross-section of the spacer is substantially triangular.

19. The tool according to claim 1, wherein a distance between the first end wall and the second end wall is such that the portion of the tie wrap is in contact with the first end wall and the second end wall.

20. The tool according to claim 1, wherein the first guide surface of the alignment guide extends from the first end wall of the first side of the housing, and wherein the second guide surface of the alignment guide extends from the second end wall of the second side of the housing.

21. The tool according to claim 1, wherein the first end wall of the first side of the housing is coplanar to the second end wall of the second side of the housing.

22. The tool according to claim 1, wherein the first two opposing side walls of the first side of the housing are parallel to each other and parallel to each of the second two opposing side walls of the second side of the housing.

23. The tool according to claim 1, wherein one of the first two opposing side walls of the first side of the housing is coplanar with one of the second two opposing side walls of the second side of the housing.

* * * * *